United States Patent [19]

Kurematsu et al.

[11] Patent Number: 4,562,144

[45] Date of Patent: Dec. 31, 1985

[54] IMAGE STABILIZER FOR SILVER HALIDE PHOTOGRAPHIC MATERIAL

[75] Inventors: Masayuki Kurematsu, Hachioji; Shigeharu Koboshi, Sagamihara, both of Japan

[73] Assignee: Konishiroku Photo Industry Co., Ltd., Tokyo, Japan

[21] Appl. No.: 661,289

[22] Filed: Oct. 17, 1984

Related U.S. Application Data

[63] Continuation of Ser. No. 460,988, Jan. 25, 1983, abandoned.

[30] Foreign Application Priority Data

Feb. 5, 1982 [JP] Japan ..... 57-17333

[51] Int. Cl.[4] ..... G03C 5/38

[52] U.S. Cl. ..... 430/372; 430/428; 430/429; 430/463

[58] Field of Search ..... 430/463, 428, 429, 372, 430/551, 216, 237

[56] References Cited

U.S. PATENT DOCUMENTS

| | | | |
|---|---|---|---|
| 2,788,274 | 4/1957 | Ranger | 430/372 |
| 3,666,468 | 5/1972 | Amano et al. | 430/428 |
| 4,343,886 | 8/1982 | Nakamura et al. | 430/551 |
| 4,423,140 | 12/1983 | Herz | 430/551 |

FOREIGN PATENT DOCUMENTS 1285313 12/1968 Fed. Rep. of Germany .

OTHER PUBLICATIONS

Hackh's Chemical Dictionary, McGraw-Hill, 12-1957, pp. 129-131.

Chemical Abstracts, vol. 68, 1968, 90386m.

*Primary Examiner*—Won H. Louie

*Attorney, Agent, or Firm*—Finnegan, Henderson Farabow, Garrett & Dunner

[57] ABSTRACT

An image stabilizer for silver halide photographic materials which contains a water-soluble bismuth compound is disclosed. In a preferred embodiment, the stabilizer also contains a water soluble chelating agent capable of forming a bismuth complex or its salt having a stability constant (log KMA) of 3 or more, said constant being represented by formula (I):

$$KMA = \frac{[MA]}{[M]\,[A]} \qquad \text{(I)}$$

wherein M is a bismuth ion and A is a complex forming anion. By using this stabilizer, the processed dye image is kept stable over an extended period and the occurrence of yellow stain in the non-image area is inhibited. The stabilizer is applicable not only to color photographic materials but also to black-and-white materials.

8 Claims, No Drawings

IMAGE STABILIZER FOR SILVER HALIDE PHOTOGRAPHIC MATERIAL

This application is a continuation, of application Ser. No. 06/460,988, filed 1/25/83, abandoned.

FIELD OF THE INVENTION

The present invention relates to an image stabilizer for use in the processing of a silver halide photographic material. More particularly, the invention relates to an image stabilizer that prevents the unexposed area of the photographic material from staining during storage after processing.

BACKGROUND OF THE INVENTION

A silver halide photographic material is processed by a sequence of imagewise exposure, color development and desilvering to form a dye image as well as reduced silver. The reduced silver is oxidized by a bleaching agent and is converted to a soluble silver complex upon treatment with a fixing agent and is washed away with water. The dye image is subsequently subjected to a stabilization step. But during extended storage, the dye image fades away and the white unexposed area turns yellow (hereunder referred to as yellow stain), and in either case, the viewing of the picture is obstructed. Of the two defects, yellow stain is known to be more conspicuous and occurs very rapidly when the photographic material is stored under strong illumination or hot and humid conditions. It has therefore been strongly desired to prevent the premature occurrence of yellow stain in stored color pictures.

Various techniques are known for preventing the occurrence of yellow stain in the color image formed on silver halide color photographic materials. U.S. Pat. Nos. 2,788,274 and 3,676,136, Japanese Patent Publications Nos. 32369/73, 20537/74, as well as Japanese Patent Applications (OPI) Nos. 47341/73, 90526/73 and 83441/74 (the symbol OPI as used herein means an unexamined published Japanese patent application) disclose the use of image stabilizers (or simply stabilizers) made, individually or in combination, of water-soluble aluminum salts, water-soluble zinc salts, water-soluble zirconium salts, sulfurous acid salts, boric acid salts, mono- or di- or polycarboxylic acids, water-soluble aldehyde compounds and water-soluble methylol compounds. Japanese Patent Publications Nos. 35240/71 and 20975/74 disclose the treatment with solutions containing UV absorbers. Japanese Patent Publication No. 30495/73 discloses the treatment with solutions containing a brightening agent. But these methods are either low in their effectiveness or accelerate the fading of dye image when they succeed in preventing yellow stain.

Color photographic materials are processed automatically and continuously by photofinishers, but with the recent concern over pollution and wasteful use of water resources, there is a great demand for saving the use of water in washing step subsequent to bleaching, fixing or blixing. But if the use of washing water is simply curtailed, the dye image on a photographic material that has been processed with a ferric complex salt of organic acid (which is a typical silver bleaching agent) is attacked by accelerated yellow stain during extended storage. As a further disadvantage, a thiosulfate or its silver complex salt conventionally used as a fixing agent builds up in the washing water to form silver sulfide. In addition, the foul washing water may contaminate the stabilizer which is often used in the subsequent step. This is another cause of the formation of silver sulfide and accelerated yellow staining of the dye image during storage.

SUMMARY OF THE INVENTION

Therefore, a general object of the present invention is to provide an image stabilizer that keeps the processed dye image stable over an extended period while inhibiting the occurrence of yellow stain in the non-image area.

A particular object of the invention is to provide an image stabilizer that keeps the dye image stable over an extended period and inhibits the occurrence of yellow stain in the non-image area even if a greatly reduced amount of water is used in the washing step.

Another object of the invention is to provide an image stabilizer that keeps the dye image stable over an extended period and inhibits the occurrence of yellow stain in the non-image area even if the washing step is substantially eliminated and there is a residuum of the bleaching agent or fixing agent that has been used to eliminate reduced silver.

Still another object of the invention is to provide an image stabilizer that remains stable over an extended period without forming a precipitate or becoming moldy even when the silver bleaching agent or fixing agent builds up in the stabilizer.

Yet another object of the invention is to provide an image stabilizer that can be used not only in processing a colour photographic material but also a black-and-white photographic material.

These objects of the present invention are achieved by an image stabilizer containing a water-soluble bismuth compound.

DETAILED DESCRIPTION OF THE INVENTION

The term "image stabilizer" as used herein means a processing solution used to stabilize a silver halide color photographic material that has been passed through the steps of color development, bleaching and fixing. More specifically, the image stabilizer is used after one of the following dye-image forming steps, i.e. color development, combined developing and fixing, and combined developing and blixing. The image stabilizer is also used after forming a silver image on a black-and-white photographic material. If it is used in a photographic process containing no washing step or after a washing step using only a very small amount of water, the stabilizer not only stabilizes the dye image but also washes out chemicals such as developing agent, bleaching agent or fixing agent that have been deposited on or introduced into the photographic material before the stabilizing step. If treatment with the stabilizer of the present invention is substituted for the conventional water washing the stabilizer is replenished in an amount of about 2,500 ml to 25 ml per square meter of the photographic material, and 1,000 ml to 50 ml, particularly 200 ml to 50 ml, per square meter of the photographic material is preferred. In this case, water more than necessary for "rinsing" purpose need not be used.

The water-soluble bismuth compound contained in the image stabilizer of the present invention dissolves in aqueous solution and may assume any form such as oxides, halides, nitrates, sulfates, carbonates, hydroxides, or even bismuth complexes or complex salts with a water-soluble chelating agent. Examples are bismuth trioxide, bismuth hydroxide, bismuth pentoxide, metabismuth salt, orthobismuth salt, bismuth sulfide, bismuth fluoride, bismuth oxyfluoride, bismuth trifluoride, bismuth pentafluoride, bismuth chloride, bismuth oxychloride, bismuth trichloride, bismuth dichloride, bismuth bromide, bismuth oxybromide, bismuth iodide, bismuth oxyiodide, bismuth hydroiodide, bismuth nitrate, bismuth oxynitrate, bismuth subnitrate, bismuth sulfate and bismuth carbonate. These bismuth compounds may combine with metal ion chelating agents to form bismuth complexes which are highly soluble in water and are used with advantage in the present invention. The metal ion chelating agent here referred to is preferably a water-soluble chelating agent to be described later which is capable of forming a complex having a stability constant (log KMA) of 3 or more with a water-soluble bismuth ion, said constant being represented by formula (I):

$$KMA = \frac{[MA]}{[M]\,[A]} \qquad \text{(I)}$$

wherein M is a bismuth ion and A is a complex forming anion. The complexes may be formed by adding bismuth compounds and chelating agents separately to the image stabilizer, or alternatively, water-soluble bismuth compounds may be reacted with water-soluble chelating agent to form complexes that are than added to the image stabilizer.

The water-soluble bismuth compound is preferably used in an amount of 0.001 to 100 g per liter of the image stabilizer. More preferably, the bismuth compound is used in an amount of 0.01 to 50 g per liter of the image stabilizer, and most preferably, the compound is used in an amount of 0.01 to 20 g.

Among the water-soluble compounds listed above, bismuth chloride, bismuth nitrate, bismuth sulfate and bismuth acetate are used with particular advantage, and preferably, they are pre-mixed with water-soluble chelating agents to form bismuth complexes or their salts.

The water-soluble chelating agent that can be used in the image stabilizer of the present invention preferably forms a chelate with bismuth ion having a stability constant (log KMA) of 3 or more, more preferably 8 or more, and most preferably 20 or more. The stability constant varies with the conditions in which the stabilizer is used, such as pH and the amount of impurities, and said constant is not the only parameter that determines an optimum water-soluble chelating agent. Therefore, any compound that has a stability constant of 3 or more can be used as the chelating agent, and the higher the water solubility of the resulting complex and the higher the stability of chelate, the better.

Illustrative water-soluble chelating agents include aminopolycarboxylic acids such as diethylenetrimainepentaacetic acid, hydroxyethyliminodiacetic acid, diaminopropanoltetraacetic acid, and transcyclohexanediaminetetraacetic acid; aminophosphonic acids such as ethylenediaminetetraquismethylenephosphonic acid and nitrilotrimethylenephosphonic acid; organic phosphonic acids such as 1-hydroxyethylidene-1,1-diphosphonic acid and 1,1-diphosphonoethane-2-carboxylic acid; phosphonocarboxylic acids such as 2-phosphonobutane-1,2,4-tricarboxylic acid and 1-hydroxy-1-phosphonopropane-1,2,3-tricarboxylic acid; polycarboxylic acids such as salicylic acid and citric acid; organic sulfonic acids such as catechol-3,5-disulfonic acid; and condensed phosphoric acid salts such as sodium pyrophosphate, sodium tetrapolyphosphate and sodium hexametaphosphate. Diethylenetriaminopentaacetic acid; hydroxyethyliminodiacetic acid, 1-hydroxyethylidene-1,1-diphosphonic acid, condensed salts thereof, and phosphoric acid salts are preferred. Particularly preferred are 1-hydroxyethylidene-1,1-diphosphonic acid and their alkali metal salts, ammonium salts and ethanolamine salts. Other compounds may also be used if they have a chelate stability constant of 3 or more. In a preferred embodiment, the chelate agents are used in admixture.

The image stabilizer of the present invention may contain other compounds such as buffers (e.g. borates, metaborates, borax, phosphates, monocarboxylates, dicarboxylates, polycarboxylates, oxycarboxylates, amino acids, primary phosphates, secondary phosphates, tertiary phosphates, sodium hyrdoxide, potassium hydroxide, and ammonia water), surfactants, mold inhibitors, preservatives and organosulfur compounds. Compounds such as aldehyde compounds conventionally used to inhibit yellow stain, as well as brightening agents and UV absorbers may also be contained in the image stabilizer without adversely affecting the objects of the present invention.

For the image keeping purpose, the stabilizer of the present invention is preferably adjusted to pH between 0.1 and 10, more preferably between 2 and 9, most preferably between 3 and 7. The stabilizer is preferably used at between 0 and 60° C., more preferably between 20 and 45° C. The processing with the stabilizer is effected in a stabilizer bath or any other suitable processing tank. The preferred processing tank is one of multi-stage countercurrent type described in S. R. Goldwasser, "Water Flow Rate in Immersion-Washing of Motion-Picture Film", Jour SMPTE., 64248-253, May, 1955. By using this type of processing tank, the additional supply of water necessary in the washing step or that of the image stabilizer of the present invention can be further decreased.

The image stabilizer of the present invention can be used in any step that follows the formation of a dye image by development. In a preferred embodiment, the stabilizer is used to process the photographic material that has passed through the steps of combined developing-blixing, bleaching or blixing. The two primary purposes of the present invention, i.e. keeping the image stable over an extended period and inhibiting yellow stain, can be achieved most effectively and economically when the treatment with the stabilizer immediately follows one of those image-forming steps without substantial water washing. The image stabilizer of the present invention proves the most effective when a ferric complex salt of organic acid is used as the silver bleaching agent. But it should be understood that the stabilizer of the present invention can be used in other embodiments and the results are better than those obtained by any of the conventional stabilizers.

The ferric complex salt of organic acid that proves the most effective when it is used as a silver bleaching agent in combination with the stabilizer of the present invention is incorporated in a bleaching solution or blix solution to oxidize the metallic silver (formed as a result of development) to convert it into silver halide. The complex salt also completes the action of the coupler. The complex salt is such that aminopolycarboxylic acid or organic polycarboxylic acid (e.g. oxalic acid or citric acid) is coordinated with an iron or other metallic ions.

The most preferred organic acid that can be used to form such ferric complex salt of organic acid is a polycarboxylic acid of formula (II) or an aminopolycarboxylic acid of formula (III):

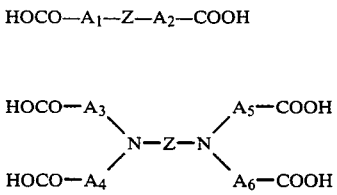

$$HOCO—A_1—Z—A_2—COOH \quad (II)$$

$$\begin{matrix} HOCO—A_3 & & A_5—COOH \\ & N—Z—N & \\ HOCO—A_4 & & A_6—COOH \end{matrix} \quad (III)$$

wherein $A_1$, $A_2$, $A_3$, $A_4$, $A_5$ and $A_6$ are each a substituted or unsubstituted hydrocarbon group; and Z is a hydrocarbon group or $>N-A_7$ (wherein $A_7$ is a hydrocarbon group or a lower aliphatic carboxylic acid group). These polycarboxylic acids and aminopolycarboxylic acids may be alkaline metal salts, ammonium salts or water-soluble amine salts. Typical examples of the carboxylic acid (II) and the aminopolycarboxylic acid (III) are listed below:

(1) ethylenediaminetetraacetic acid;
(2) diethylenetriaminepentaacetic acid;
(3) ethylenediamine-N-(β-oxyethyl)-N,N',N'-triacetic acid;
(4) propylenediaminetetraacetic acid;
(5) nitrilotriacetic acid;
(6) cyclohexanediaminetetraacetic acid;
(7) iminodiacetic acid;
(8) dihydroxyethylglycine;
(9) ethylether diaminetetraacetic acid;
(10) glycolether diaminetetraacetic acid;
(11) ethylenediaminetetrapropionic acid;
(12) phenylenediaminetetraacetic acid;
(13) sodium ethylenediaminetetraacetate;
(14) tetra(trimethylammonium) ethylenediaminetetraacetate;
(15) tetra-sodium ethylenediaminetetraacetate;
(16) penta-sodium diethylenetriaminepentaacetate;
(17) sodium ethylenediamine-N-(β-oxyethyl)-N,N',N'-triacetate;
(18) sodium propylenediaminetetraacetate;
(19) sodium nitrilotriacetate;
(20) sodium cyclohexanediaminetetraacetate;
(21) citric acid;
(22) oxalic acid;
(23) maleic acid;
(24) tartaric acid;
(25) succinic acid;
(26) sulfamic acid;
(27) phthalic acid; and
(28) gluconic acid;

Particularly preferred organic acids include ethylenediaminetetraacetic acid, diethylenetriaminepentaacetic acid, and glycolether diaminetetraacetic acid. The above listed organic acids, when used in the stabilizer, exhibit high ability to form a chelate with bismuth ion. They are most preferably used in combination with phosphonic acid chelating agents.

In the present invention, silver bleaching agents or oxidizing agents other than the ferric complex salt of organic acid may be used, and persulfates, hydrogen peroxide, iron chloride and ferric ferricyanine are preferred. It is very effective for the purposes of the present invention to use a fixing bath, bleach-fixing bath or combined developing and blixing bath containing a thiosulfate or thiocyanate as the main component, but other fixing agents are not excluded. Suitable fixing agents are those which form a water-soluble silver complex from bleached silver, and typical examples include sodium thiosulfate, ammonium thiosulfate, potassium thiosulfate, potassium thiocyanate, ammonium thiocyanate and sodium thiocyanate.

The washing step may be omitted after treatment with the stabilizer of the present invention, but if desired, rinsing with a small amount of water or surface washing in a very short time may be effected. Such optional washing is effectively performed by rubbing the processed photographic material with a wet sponge.

The treatment with the stabilizer of the present invention is advantageously applied to silver halide photographic materials such as color paper, reversal color paper, color positive paper, color negative film, color reversal film and color X-ray film. The treatment is also applicable to black-and-white photographic materials. Any soluble silver salt can be recovered from the stabilizer of the present invention by suitable methods such as passing through an ion exchange resin, metal displacement, electrolysis and silver sulfide precipitation.

The present invention is now described in greater detail by reference to the following examples which are given here for illustrative purposes only and are by no means intended to limit the scope of the invention.

EXAMPLE 1

Samples of Sakura color paper (product of Konishiroku Photo Industry Co., Ltd.) were subjected to imagewise exposure at a reflection density of 1.5. They were subsequently processed in a usual manner comprising color development, bleach-fixing and washing, and immersed in 1000 ml of stabilizer formulations Nos. 1 to 14 (indicated in Table 1) at 33° C. for 1 minute. The stabilized samples were dried and their red reflection density and yellow stain density in the unexposed area were measured. Thereafter, the samples were subjected to an accelerated deterioration test for 20 days in a bath held at 60° C. and 90% rh. The decrease in the red reflection density and the density of yellow stain in the unexposed area of each deteriorated sample were measured. The results are shown in Table 2.

TABLE 1

| Chemicals | Formulation No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| citric acid (g) | — | 10 | 10 | — | — | — | — | — | — | — | — | — | — | — |
| zinc sulfate (g) | — | 10 | — | — | — | — | — | — | — | — | — | — | — | — |
| formaldehyde (ml) (35% sol.) | — | — | 5 | — | — | — | — | — | — | — | — | — | — | — |
| brightener* (g) | — | — | 1 | — | 1 | — | — | 1 | 1 | — | — | — | — | — |
| 1-hydroxyethylidene-1,1-diphosphonic acid (g) | — | — | — | 2 | — | — | — | 2 | — | 2 | 2 | 2 | — | — |
| hydroxyethylimino-diacetic acid (g) | — | — | — | — | 2 | — | — | — | 2 | — | — | — | — | — |

TABLE 1-continued

| Chemicals | Formulation No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| bismuth nitrate (g) | — | — | — | — | — | 0.05 | 0.5 | 0.5 | 0.5 | 0.005 | 0.05 | 1.0 | — | — |
| complex of 1-hydroxyethylidene 1,1-diphosphonic with bismuth nitrate (g) | — | — | — | — | — | — | — | — | — | — | — | — | 30 | 100 |
| pH (adjusted with KOH and glacial acetic acid) | 4.2 | 4.2 | 4.2 | 4.2 | 4.2 | 4.2 | 4.2 | 4.2 | 4.2 | 4.2 | 4.2 | 4.2 | 4.2 | 4.2 |
| | Comparative samples | | | | | | sensitizers of the present invention | | | | | | | |

*"Kaykol PK Conc." of Shinnisso Kako Kabushiki Kaisha was used as the brightener.

TABLE 2

| | Formulation No. | Decrease in red reflection density (%) | Yellow stain (blue reflection density) Initial | After accelerated deterioration |
|---|---|---|---|---|
| comparative samples | 1 | 17 | 0.06 | 0.28 |
| | 2 | 35 | 0.06 | 0.26 |
| | 3 | 68 | 0.06 | 0.16 |
| | 4 | 17 | 0.06 | 0.24 |
| | 5 | 19 | 0.06 | 0.24 |
| Sensitizers of the present invention | 6 | 15 | 0.06 | 0.19 |
| | 7 | 15 | 0.06 | 0.19 |
| | 8 | 12 | 0.06 | 0.17 |
| | 9 | 12 | 0.06 | 0.17 |
| | 10 | 16 | 0.06 | 0.19 |
| | 11 | 14 | 0.06 | 0.18 |
| | 12 | 12 | 0.06 | 0.17 |
| | 13 | 21 | 0.06 | 0.16 |
| | 14 | 36 | 0.06 | 0.12 |

As is clear from Table 2, control stabilizers Nos. 2, 4 and 5 was no more effective than sample No. 1 (acidic water only) in inhibiting yellow stain. Sample No. 4 was somewhat effective but then, the photographic material processed with it experienced a significant drop in red reflection density. Stabilizers Nos. 6 to 14 according to the present invention were very effective in inhibiting yellow stain and the drop in the red reflection density was very small. As a result, the dye image and unexposed area of the photographic materials treated with these samples remained very stable.

EXAMPLE 2

A roll of Sakura color paper was printed in an imagewise pattern and subjected to continuous processing (running processing) in an automatic developer of endless belt type according to Schemes Nos. 1 and 2 specified below. The processing steps and the formulations of the processing solutions employed therein are identified below.

| Processing steps | |
|---|---|
| 1. Color development | 33° C., 3 min. 30 sec. |
| 2. Bleach-fixing | 33° C., 1 min. 30 sec. |
| 3. Stabilization | 25–30° C., 3 min. |
| 4. Drying | 75–80° C., ca. 2 min. |

| Liquor in color developing tank | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| 1-Hydroxyethylidene-1,1-diphosphonic acid | 1.0 g |
| Magnesium chloride hexahydrate | 0.5 g |

-continued

| | |
|---|---|
| Hydroxyethyliminodiacetic acid | 3.0 g |
| 3-Methyl-4-amino-N—ethyl-N—(β-methanesulfonamidoethyl)-aniline sulfate | 5.5 g |
| Brightener (4,4'-diaminostilbenedisulfonic acid derivative) | 1.0 g |
| Potassium hydroxide | 2.0 g |
| Water to make | 1,000 ml |
| Replenisher for color development tank | |
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| 1-Hydroxyethylidene-1,1-diphosphonic acid | 2.0 g |
| Magnesium chloride hexahydrate | 0.8 g |
| Hydroxyethyliminodiacetic acid | 3.5 g |
| 3-Methyl-4-amino-N—ethyl-N—(β-methanesulfonamidoethyl)-aniline sulfate | 7.0 g |
| Brightener (4,4'-diaminostilbenedisulfonic acid derivative | 1.5 g |
| Potassium hydroxide | 3.0 g |
| Water to make | 1,000 ml |
| Liquor in bleach-fixing tank | |
| Ethylenediaminetetraacetate acid ferric ammonium dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Water to make | 1,000 ml |
| pH adjusted at 7.1 with potassium carbonate or glacial acetic acid | |
| Replenisher A for bleach-fixing tank | |
| Ethylenediaminetetraacetate ferric ammonium dihydrate | 260 g |
| Potassium carbonate | 42 g |
| Water to make | 1,000 ml |
| pH adjusted at 6.7 ± 0.1 | |
| Replenisher B for bleach-fixing tank | |
| Ammonium thiosulfate (70% solution) | 500 ml |
| Ammonium sulfite (40% solution) | 250 ml |
| Ethylenediaminetetraacetic acid | 17 g |
| Glacial acetic acid | 85 ml |
| Water to make | 1,000 ml |
| pH adjusted at 4.6 ± 0.1 | |

The automatic developer was charged with the color development liquor, bleach-fixing liquor and one of the stabilizer formulations indicated below. Color paper samples were subjected to a running test by supplying the color development replenisher, bleach-fixing replenishers A and B and stabilizer replenisher (to be identified below) through a metering cup at 3-minute intervals. The development replenisher was supplied in an amount of 324 ml, and blix replenishers A and B were each supplied in an amount of 25 ml per square meter of the color paper. The stabilizing tank was of countercurrent type that consisted of first, second and third compartments in the order of the supply of the color paper. The stabilizer was first fed to the third compartment, the overflow being fed to the second compartment, and the overflow from the second compartment was directed to the first compartment, and the overflow from the first chamber was discharged out of the machine.

The running processing according to Scheme No. 1 was regarded as being stationary when the total amount of the blix replenisher (replenishers A and B plus the color developer carried by the photographic material into the blixing tank) became twice the tank capacity.

Scheme No. 1

In one control experiment, an aqueous solution (formulation No. 1 in Table 3) containing 2 g of glacial acetic acid per liter and which was adjusted to pH 4.2 with sodium hydroxide was passed through the stabilizer tank in an amount of 200 ml per square meter of color pepr. When the stabilizer composition and the carryover from the blixing solution was found to have become stable by sampling the liquor in each compartment of the stabilizer tank, various compounds were added to the liquor in each compartment according to formulations Nos. 2 to 9 noted in Table 3, and each liquor was adjusted to a pH of 4.2 with aqueous sodium hydroxide.

Sakura color paper samples that had been subjected to imagewise exposure at a reflection density of 1.5 were processed according to the above scheme, and their red reflection density and yellow stain density in the unexposed area were measured. Thereafter, the samples were subjected to an accelerated deterioration test for 10 days in a bath held at 60° C. and 80% rh. The decrease in the red reflection density and the density of yellow stain in the unexposed area of each deteriorated sample were measured. The results are shown in Table 4. Table 4 also lists the date of a photographic material that was not stabilized but washed with a large quantity of water as in the conventional manner.

Scheme No. 2

After the running processing in Scheme No. 1, samples were taken from the liquor in the third compartment of the stabilizing tank and transferred to conical flasks (500 ml capacity) which were left to stand for 40 days during which the samples were checked for the formation of a precipitate. The results are noted in Table 5.

TABLE 4

| | Formulation | Decrease in red reflection density (%) | Yellow stain (blue reflection density) Initial | After accelerated deterioration |
|---|---|---|---|---|
| | Water washing | 9 | 0.06 | 0.12 |
| Comparative samples | 1 | 5 | 0.07 | 0.23 |
| | 2 | 12 | 0.07 | 0.21 |
| | 3 | 23 | 0.07 | 0.20 |
| | 4 | 37 | 0.07 | 0.13 |
| | 5 | 11 | 0.07 | 0.21 |
| | 6 | 39 | 0.06 | 0.13 |
| | 7 | 8 | 0.07 | 0.21 |
| sensitizers of the present invention | 8 | 6 | 0.06 | 0.08 |
| | 9 | 6 | 0.06 | 0.08 |

TABLE 5

| | Formulation No. | Change with time: days passed 10 | 20 | 30 | 40 |
|---|---|---|---|---|---|
| Comparative samples | 1 | − | + | ++ | ++ |
| | 2 | − | + | ++ | ++ |
| | 3 | ++ | ++ | ++ | ++ |
| | 4 | ++ | ++ | ++ | ++ |
| | 5 | − | + | ++ | ++ |
| | 6 | ++ | ++ | ++ | ++ |
| | 7 | − | − | + | ++ |
| Sensitizers of the present invention | 8 | − | − | − | − |
| | 9 | − | − | − | − |

−: transparent, no precipitate
+: some precipitate, a bit cloudy
++: much precipitate, cloudy throughout As Table 4 shows, the sample that was directly stabilized with formulation No. 1 (simply pH-adjusted with acetic acid) without washing had a bit more yellow stain and faded more than the sample that was not stabilized and simply washed with water. In an experiment using a stabilizer that was not pH-adjusted, the degree of yellow stain was more than 0.3. Stabilizer formulations Nos. 2 to 7 were the same as those which were conventionally used to inhibit yellow stain and they consisted of citric acid (polycarboxylic acid) either alone or in combination with potassium aluminum sulfate 24 hydrate (water-soluble aluminum salt), zinc sulfate (water-soluble zincic acid) or zirconium sulfate (water-soluble zirconium salt). They could only slightly inhibit the occurrence of yellow stain. Formulations Nos. 4 and 6 that also contained formaldehyde (alde-

TABLE 3

| Compounds | Formulation No. 1 | 2 | 3 | 4 | 5 | 6 | 7 | 8 | 9 |
|---|---|---|---|---|---|---|---|---|---|
| citric acid (g) | — | 10 | 10 | 10 | 10 | — | — | — | — |
| potassium aluminum sulfate 24 hydrate (g) | — | — | 10 | 10 | — | — | — | — | |
| zinc sulfate (g) | — | — | 10 | — | — | — | — | — | — |
| formaldehyde (35% sol.) (g) | — | — | — | 5.0 | — | 5.0 | — | — | — |
| zirconium sulfate (g) | — | — | — | — | 10 | — | — | — | — |
| brightener* (g) | — | — | — | — | — | 1.0 | 1.0 | 1.0 | — |
| 1-hydroxyethylidene-1.1-diphosphonic acid (g) | — | — | — | — | — | — | 4.0 | 4.0 | 4.0 |
| bismuth chloride (g) | — | — | — | — | — | — | — | 1.0 | 1.0 |
| mold inhibitor** (g) | — | — | — | — | 0.05 | — | 0.05 | 0.05 | — |
| | comparative samples | | | | | | | sensitizers of the present invention | |

*"Kaykol PK Conc." of Shinnisso Kako Kabushiki Kaisha was used in the brightener.
**2-(4-Thiazolyl)benzimidazole was used as the mold inhibitor.

hyde compound) were particularly unsuitable for practical use since they accelerated the decrease in the density of cyan dye.

Formulations Nos. 8 and 9 according to the present invention were very effective in inhibiting yellow stain without decreasing the density of cyan dye. As is clear from Table 5, the stabilizers of the present invention were entirely free from precipitate during extended storage. They were also free from putrefaction, mold or bacterial growth. Therefore, they were very effective not only in eliminating the washing step or reducing the amount of water to be used in the washing step but also in decreasing the additional supply of stabilizer replenisher.

EXAMPLE 3

Samples of black and white photographic film Yoshino FS (product of Konishiroku Photo Industry Co., Ltd.) were developed with Konitone (the trade name for a developing agent of Konishiroku Photo Industry Co., Ltd.), fixed with Koni-fix (the trade name for a fixing agent of the same company), washed under flushing water for 2 minutes, immersed in 5 stabilizers of the formulations listed in Table 6 for one minute at 20° C., and dried.

TABLE 6

| | Formulation No. | | | | |
|---|---|---|---|---|---|
| | 1 | 2 | 3 | 4 | 5 |
| glacial acetic acid (g) | 2 | 2 | — | 2 | — |
| brightener* (g) | — | 2 | — | — | 2 |
| 1-hydroxyethylidene-1,1-diphosphonic acid (g) | — | 2 | — | 2 | 2 |
| bismuth chloride (g) | — | — | 0.1 | 0.4 | 0.4 |
| pH (adjusted with KOH and glacial acetic acid after water was added to make 1,000 ml) | 4.0 | 4.0 | 4.0 | 4.0 | 4.0 |
| | comparative samples | | sensitizers of the present invention | | |

*"Cinobal MSP" of Ciba-Geigy AG was used as the brightener.

The processed samples were subjected to an accelerated deterioration test for 40 days at 60° C. and 80% rh. under illumination of 200 lux. Compared with the samples stabilized with control formulations Nos. 1 and 2, those which were stabilized with formulations Nos. 3 to 5 had very low minimum white densities (stain) in the unexposed area. The samples stabilized with the control formulations turned brown in the silver image area, but browning taking place in those stabilized with the formulations of the present invention was negligible.

These differences increased when the samples were directly stabilized without washing with water. The increase in the hellow stain in the unexposed area and the browning of the silver image area were accelerated in the samples stabilized with the control formulations without washing with water, but the samples stabilized with the formulations of the present invention were effectively protected against increasing stain in the unexposed area and browning in the silver image area even when no washing was conducted. This data shows that the stabilizer of the present invention is also effective for black-and-white photographic materials.

What is claimed is:

1. A method of treating an exposed silver halide photographic material, after bleaching or bleach-fixing, comprising the step of treating said photographic material containing a dye image with an aqueous stabilizing solution which contains a water-soluble bismuth compound.

2. A method according to claim 1, wherein said water-soluble bismuth compound is a bismuth complex or its salt chelated with a water-soluble chelating agent.

3. A method according to claim 2, wherein said bismuth complex or its salt has a stability constant (log KMA) of 3 or more, said constant being represented by formula (I):

$$KMA = \frac{[MA]}{[M]\,[A]} \qquad \text{(I)}$$

wherein M is a bismuth ion and A is a complex forming anion.

4. A method according to claim 2, wherein said water-soluble chelating agent is at least one compound selected from the group consisting of aminopoly carboxylic acids, aminophosphonic acids, organic phosphonic acids, phosphonocarboxylic acids, poly carboxylic acids, organic sulfonic acids and condensed phosphonic acid salts.

5. A method according to claim 1, wherein said water-soluble bismuth compound is a complex with at least one compound selected from the group consisting of diethylenetriaminopentaacetic acid, hydroxyethyliminodiacetic acid, 1- hydroxyethylidene-1,1-diphosphonic acid, condensed salts thereof and phosphonic acid salts.

6. A method according to claim 1, wherein said aqueous stabilizing solution contains a water-soluble chelating agent in addition to said water-soluble bismuth compound.

7. A method according to claim 6, wherein said water-soluble chelating agent is one capable of forming a bismuth complex or its salt having a stability constant (log KMA) of 3 or more, said constant being represented by formula (I):

$$KMA = \frac{[MA]}{[M]\,[A]} \qquad \text{(I)}$$

wherein M is a bismuth ion and A is a complex forming anion.

8. A method according to claim 1, wherein said water-soluble bismuth compound is used in an amount of 0.001 to 100 g per liter of the aqueous solution.

* * * * *